United States Patent [19]

Kent

[11] 4,196,767

[45] Apr. 8, 1980

[54] COMBINATION CONTROL PANEL

[76] Inventor: James Kent, 19 Belmont St., South Easton, Mass. 02375

[21] Appl. No.: 942,417

[22] Filed: Sep. 14, 1978

[51] Int. Cl.[2] ..... E04B 3/28

[52] U.S. Cl. ..... 160/91; 52/203

[58] Field of Search ..... 160/89-92; 52/202, 203

[56] References Cited

U.S. PATENT DOCUMENTS

| | | | |
|---|---|---|---|
| 341,112 | 5/1886 | Teufel | 52/202 |
| 893,594 | 7/1908 | Rodney | 160/90 |
| 2,324,139 | 7/1943 | Davis | 160/91 |
| 2,539,827 | 1/1951 | Gill | 160/92 |
| 2,715,249 | 8/1955 | Nelson | 160/91 |
| 2,879,840 | 3/1959 | Etten | 160/91 |
| 2,923,982 | 2/1960 | Burkland | 160/91 |
| 3,090,646 | 5/1963 | Johnson | 296/107 |
| 3,214,879 | 11/1965 | Ellingson | 52/202 |
| 4,068,428 | 1/1977 | Peterson | 52/202 |

FOREIGN PATENT DOCUMENTS

| | | | |
|---|---|---|---|
| 566679 | 11/1958 | Canada | 160/91 |
| 2610214 | 9/1977 | Fed. Rep. of Germany | 52/202 |

*Primary Examiner*—James A. Leppink

*Assistant Examiner*—Henry E. Raduazo

*Attorney, Agent, or Firm*—Carl P. Steinhauser

[57] ABSTRACT

A lightweight removable combination air and insect control panel for mounting on the internal or external sides of window frames in situ for the tight sealing thereof, said panel having two portions, a full frame portion having a sheet of rigid transparent material in its upper second and a sheet of screen material in its lower section, both being tightly secured in a lightweight frame structure. A second half-frame portion has a sheet of rigid transparent material secured in a similar half-size perimeter frame sized to fit over the screened section of the full frame portion. The frame structure also includes grooves for the insertion and securing of flexible weather stripping to ensure a tight retention of the screen material and a tight seal against the window frame. Two circular loops at the top of the panel engage corresponding hooks on the window frame. A minimal number of side and base spring loaded fastening means are used to secure the combination control panel in its sealed position. Using only the full frame portion, the combination control panel functions as a window screen. Hanging the half-frame portion over the screened section converts it to a full storm sash or air control panel.

4 Claims, 10 Drawing Figures

COMBINATION CONTROL PANEL

FIELD OF THE INVENTION

This invention pertains to combination insulating window frames and window screening, and in particular detail the type of interior storm windows used to insulate a building from coal air and screening generally used when windows are open to prevent insects from entering the screened facility. Specifically, it is a combination air Pat. panel and screened insect control panel designed for quick installation and removal from the interior frame of a window. Its design permits a tighter seal against the window frame than heretofore available and thus is more effective in the prevention of the entry of cold air and insects into the protected facility.

Description of the Prior Art

The prior patent art in the field of interior window sash is discussed in detal in U.S. Pat. No. 4,068,428, and in applicant's earlier U.S. Pat. application Ser. No. 905,157, which discloses a companion interior storm sash having glass panels and in applicant's earlier U.S. Pat. application Ser. No. 932,270 which discloses an interior insect control screen. Applicant knows of no prior art pertaining to similar types of combination interior storm windows and screens. The present application discloses a combination interior storm window and screen which is very similar to his interior air control panel and insect control panel disclosed in his prior applications. All of the remarks in those applicatons pertaining to deficiencies of prior art frames for window sash are incorporated herein by reference.

The basic problem with prior art combination sash and screening, whether it be interior or exterior, is that it is framed loosely and then fitted loosely to the window frames. While the sash or screening may be effective in preventing the entry of cold air or insects, the loose fitting of the sash or screen to its frame and the frame to the window frame allows the penetration of cold air and insects around the sash or screen, thus significantly decreasing the effectiveness of the insulating value of the sash and the screening against smaller insects up to and including those having the size of mosquitos and small flies. The combination control panel of this invention is specifically designed to solve this problem.

The principal object of this invention is to provide a combination control panel in the form of an interior mounted sash and screen in which both sash and screen are tightly fitted to the frame and the combination frame is tightly fitted to the window frame, thus sealing an open window effectively against the penetration of cold air or insects.

It is a further object of this invention to provide an internally mounted combination air control and insect control panel which is difficult for an observer to see, and when seen, is attractive looking to the observer. It is also an object of this invention to provide a combination control panel which can easily be attached to and removed from a window frame without leaving unsightly marks thereon. It is also an object of this invention to provide a combination control panel that is uncomplicated to install and remove, while being attractive in appearance. It is a further object of this invention to provide a combination control panel with structural rigidity to seal windows of some expanse without sacrificing the tight seal required for effective prevention of cold air or insect penetration.

From the prior art discussion the design criteria for a combination control panel are evident. An effective combination control panel must have structural rigidity; it must require minimal and unobtrusive installation hardware; it must be easily mounted and dismounted repetitively; it must be difficult to detect and, if detected, it must be attractive in appearance; and most importantly it must provide an extremely tight air seal and it must be very inexpensive to manufacture.

The insulation window of U.S. Pat. No. 4,068,428 fails to meet these design criteria since it has no basic frame and even the more limited design criteria which it professes to meet. It cannot be converted to a screening device because it is a transparent sheet of rigid plastic without a frame structure. Even if it were converted to a frame structure by using the transparent plastic as a frame it would be ineffective. Weather stripping secured to a plastic frame will not provide an air tight seal and will eventually fail. It also detracts from appearance. As plastic materials approach the design criteria for structural rigidity, they become more and more expensive; in fact, too expensive for the intended purpose. No adhesives will sustain the continued adhesion of the weather stripping to the plastic for a long period of time. And, finally, despite claims to the contrary the panel of this patent cannot provide an efficient air tight seal against the window frame. Thus, the device of this patent fails to meet the two most important design criteria, low manufacturing cost and effective air-tight sealing.

SUMMARY OF THE INVENTION

According to the principles of this invention, a combination control panel includes one full panel having a glass pane in its upper half and a sheet of screening material in its bottom half secured in a thin, lightweight frame, preferably aluminum, to provide structural rigidity. It also includes an additional one-half frame having only a glass panel. Said full panel frame has a horizontal cross member to insure structural rigidity over larger expanses, and to separate the glass and screen portions, said cross member being spaced over a cross-member of existing windows to be unobtrusive to view. Said frame further includes grooves to secure a flexible, tubular-type weather stripping which helps provide an airtight seal against the window frame and to secure the glass and screening material in an airtight seal within the frame. A pair of spaced apart loops secured to the top of the frame engage a pair of correspondingly spaced apart hooks on the window frame to hang the combination control panel. Pivotal spring clips on the window frame are turned to a horizontal position to forcefully engage the combination control panel in an air tight seal against the window frame. A minimum number of such clips are required. For ease of handling a plurality of said panels may be utilized to cover large expanses such as picture windows. The half-frame with only the glass panel is similarly constructed. To serve as an air control panel it is hung on the horizontal cross member of the full frame combination panel such that it is tightly sealed against that portion of the full frame which is screened. When its cold air insulation is not required, it is unhooked, reversed and suspended for storage on the same hooks as the full panel is hung.

The combination control panel of this invention is simple in design, rigid in structure, has no movable parts, is virtually maintenance free and meets all the design criteria specified above. In particular, it provides the tightest air seal yet achieved and hence the most effective combination control panel for preventing the penetration of cold air and insects around the screen.

DESCRIPTION OF THE PREFERRED EMBODIMENT

Figure 2:
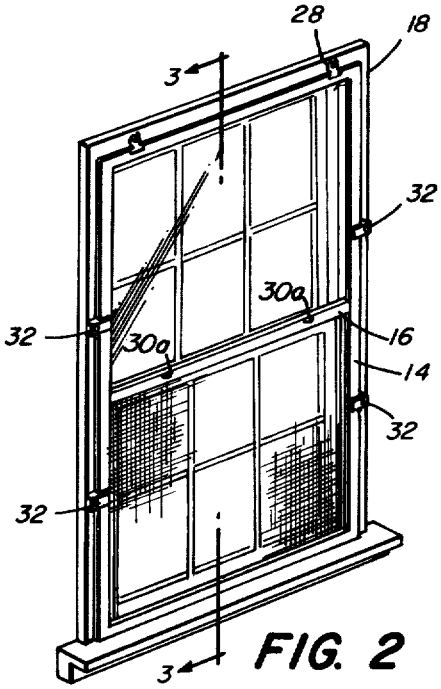
FIG. 2 is an isometric view of the full frame portion of the combination contraol panel of this invention installed within an interior window frame.
Figure 1:
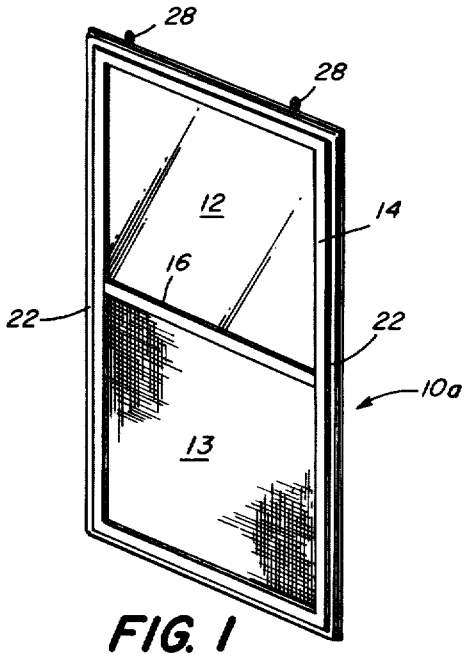
FIG. 1 is an isometric view of a combination control panel employing the principles of this invention and showing the full frame portion.

Referring now to the drawings, in which reference numerals refer to the same parts throughout the different views, FIG. 1 is an isometric or perspective view of the full frame portion of the combination control panel of the present invention, designated generally by the reference numeral 10*a*. Combination control panel 10 is designed to be mounted to the interior of a window casing frame and to be fitted in a sealed, air tight engagement therewith. The view of FIG. 2 is that of the panel 10 as seen by a person within the room.

Combination control panel 10 includes in its full frame portion 10*a*, as the upper half thereof, a sheet of very rigid, transparent material 12 having high surface abrasion resistant characteristics. Preferably, this material should be glass for reasons of cost, abrasion resistance, transparency, ease of cleaning and structural rigidity. Material 12 is secured tightly within a perimeter frame 14 as illustrated in FIG. 4.

Figure 9:
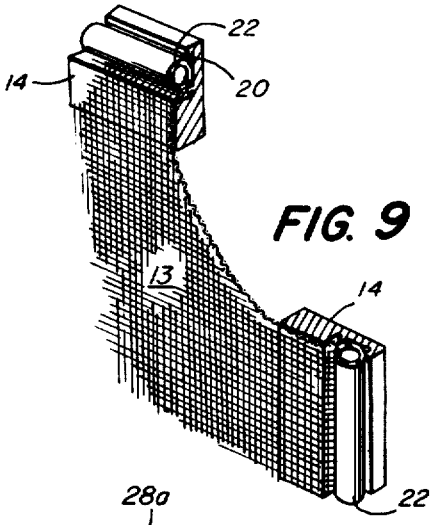
FIG. 9 is a cut-away view showing details of the frame and sealing means for the screen section of the combination control panel.

The full frame portion of combination control panel 10*a* also includes a sheet of screening material 13 in its lower half having the usual meshed screen characteristics. Screening material 13 is secured tightly within a perimeter frame 14 as illustrated in FIG. 9. Preferably, perimeter frame 14 is of light weight aluminum or similar material. The purpose of perimeter frame 14 is to provide structural rigidity, a convenient means to secure the sealing materials and weather stripping and a means to support the minimal mounting hardware required. Perimeter frame 14 has a horizontal cross-member 16, as shown in FIG. 1 to provide additional structural rigidity. Preferably, perimeter frame 14 and horizontal cross members 16 are of a very thin guage aluminum, just strong enough to support the weight of the transparent panel 12 and meshed screen material 13. Transparent panel 12, preferably of glass, will have a weight in proportion to the expanse of window it must enclose. Transparent member 12 is secured to perimeter frame 14 and cross-member 16 by an air-tight marine glazing 26 in frame ridge 24 as shown in FIG. 4.

Screen material 13 will have a slight weight in proportion to the expanse of window it must enclose. Screen material 13 is secured to perimeter frame 14 and cross-member 16 by the weather-stripping 22 in frame edge 24, as shown in FIG. 9. Perimeter frame 14 is sized to be slightly larger than the window such that it sits tightly within the window casing frame 18 and flush against its molding, as shown in FIGS. 2, 3, 7 and 8.

Figure 3:
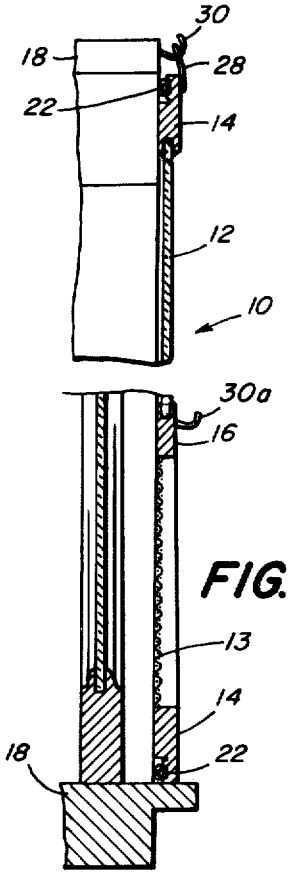
FIG. 3 is a section view taken along the line 3—3 of FIG. 2.
Figure 4:
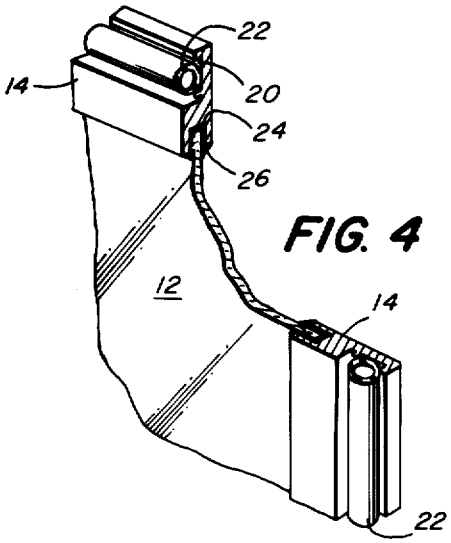
FIG. 4 is a cut-away view showing details of the frame and sealing means of the air control section of the combination panel of FIG. 1.

Referring now to FIG. 4, the perimeter frame 14 of combination control panel has a ridge 20 on its interior side. Ridge 20 serves to secure a tubular perimeter weather stripping 22 formed of a resilient plastic tubing which extends continuously about the perimeter of frame 14. Tubular weather stripping 22 is formed of a plastic which compresses easily when urged against the window frame casing 18 as is depicted in FIG. 3. Tubular weather stripping 22 is secured to ridge 20 by an appropriate adhesive, as illustrated in FIG. 3.

Tubular weather stripping 22 also secures screening material 13 of the bottom half of full frame portion 10*a* of combination control panel 10 tightly against perimeter frame 14. Screen material 13 is pulled tightly against the edges of frame 14 and positioned within ridge 20. It may be glued in position also. When tubular weather stripping 22 is forced into ridge 20, it tightens the screen material 13 in position. Thus, weather stripping 22 serves a dual purpose. It secures screen material 13 tightly against frame 14 and it provides an air-tight seal for frame 14 against window frame 18.

The full frame portion 10*a* of combination control panel 10 is hung on window casing frame 18 by means of loops 28 secured to the upper perimeter edge of perimeter frame 14. Loops 28 engage similarly positioned hooks 30 secured to window casing frame 18, as illustrated in FIG. 2. Combination control panel 10 is further secured to window casing frame 18 by a minimal number of spring clips 32 which are screwed to window casing frame 18 along the edges of its side perimeter molding and turned ninety degrees inward to overlap the sides of perimeter frame 14, thus holding it tightly against window casing frame 18, as illustrated in FIG. 2.

FIG. 2 illustrates the full frame portion 10*a* of combination control panel 10 as installed on the interior of a window frame 18.

FIG. 3 is a cross-sectional view of installed full frame portion 10*a* of combination control panel 10 taken along the lines 3—3 of FIG. 2. This view shows at its top window casing frame 18 having tubular weather stripping member 22 tightly compressed against window casing 18, this insulating member 22 securely held in ridge 20 of perimeter frame 14. A horizontal cross-member 16 is also shown. The base of full frame control panel 10*a* is similar to its top. Two clips 32 are shown in position. FIG. 3 also shows the upper glass 12 and lower screen material 13 in position.

FIG. 4 is a cutaway detailed view showing the relative positions of 20, 24, and the tubular weather stripping 22 and the glass 12 installed in said ridges in the upper half of full frame portion 10*a* of a combination control panel 10.

Figure 5:
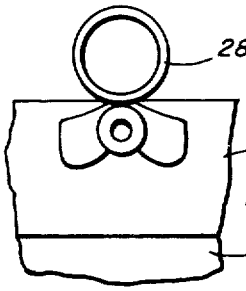
FIG. 5 is a plan view showing the mounting means of the combination control panel of this invention.

FIG. 5 is a plan view of the loops 28 attached to upper perimeter frame 14 used to hang air control panel 10 to window casing frame 18. The conventional spring clips 32 which force air control panel 10 against window casing 18 are not shown in this view. Since insulated tubular weather stripping 22 is secured uniformly about the entire perimeter of frame 14 of full frame control panel 10, a very tight seal is obtained, thereby increasing the effectiveness of full frame control panel 10*a*.

Figure 10:
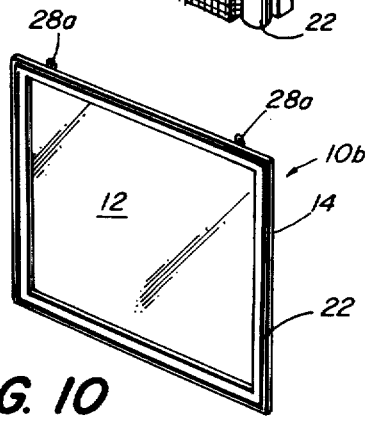
FIG. 10 is an isometric view of the one-half frame glass panel of the combination control panel.

FIG. 10 illustrates the half-frame portion 10*b* of combination control panel 10. It is similar in construction to the glass section of full frame portion 10*a*, and includes hooks 28*a* for hanging.

Figure 6:
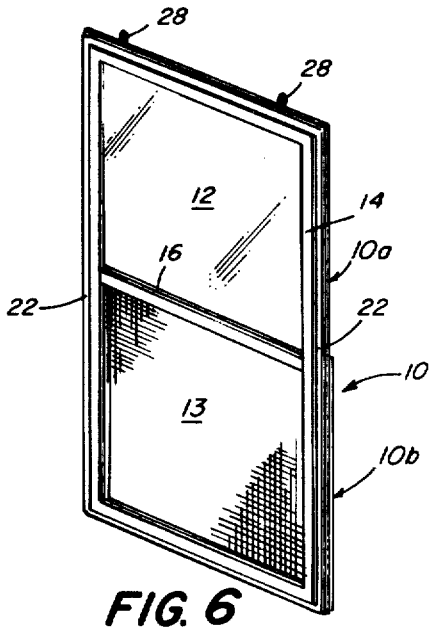
FIG. 6 is an isometric view of the combination control panel of the present invention showing the full frame upper glass and lower screen sections and a lower glass half-frame in position.

FIG. 6 shows half-frame portion 10*b* hung on the interior-facing side of full frame portion 10*a*, behind screen material 13. In this arrangement combination control panel 10 is a full air control panel for insulating a window from its interior side. Half-frame portion 10*b* is hung from hooks 30*a* on horizontal cross-member 16 and also tightly engaged by spring clips 32*a* as shown in FIG. 7.

Figure 7:
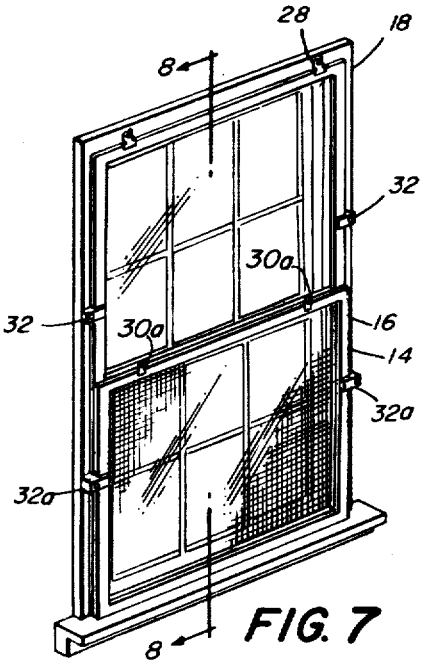
FIG. 7 is an isometric view of the complete combination control panel of this invention installed within a window frame, the screened portion being covered by the glass half-frame portion.

FIG. 7 shows the full combination control panel 10 as installed on a window for cold air insulation. For an open screening effect, half-frame portion 10*b* is then taken off the lower hooks 30*a*, reversed and hung on the upper hooks 30.

Figure 8:
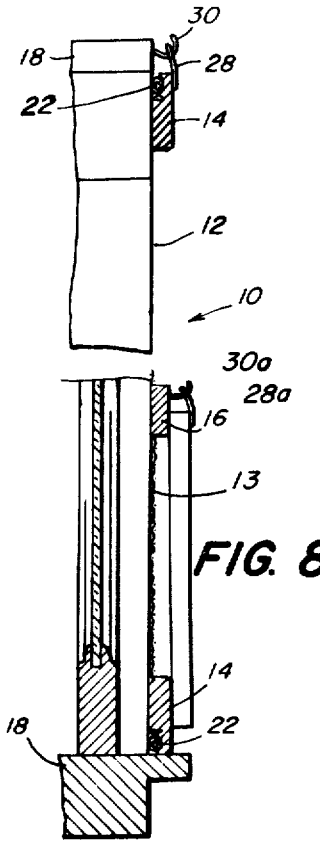
FIG. 8 is a sectional view taken along the line 8—8 of FIG. 7.

FIG. 8 is a sectional view of combination control panel 10 taken along the line 8—8 of FIG. 7. This view shows at its top window casing frame 18 having tubular weather stripping member 22 tightly compressed against window casing 18, this tubular member securely held in ridge 20 of perimeter frame 14. Horizontal cross-member 16 is shown with hooks 30*a* on its interior-facing side for hanging half-frame glass portion 10*b* (FIG. 10) over the screening 13 of full frame portion 10*a* to make combination control panel 10 an interior hung air control panel. Half-frame portion 10*b* may be held securely in an air-tight fit against the lower half of full frame portion 10*a* by spring clips 32*a*. When it is desired to open the window to let air in, half-frame portion 10*b* is removed from hooks 30*a* and may be stored by reversing it and hanging it on hooks 30 so that it lies flat against the upper glass panel of full frame portion 10*a*.

FIG. 9 is a cut-away detailed view showing the relative positions of 20, 24 and the tubular weather stripping 22 and the screen material 13 installed in said ridges.

FIG. 10 is an isometric view of half-frame portion 10*b* of combination control panel 10. Half-frame portion 10*b* is constructed exactly like the glass half of full portion 10*a*, as illustrated in FIGS. 3, 4 and 5.

In the construction of combination control panel 10, the perimeter frames 14 are cut to the size of the window casing frame 18. The cross-members 16 are cut to fit perimeter frame 14. The glass 12 and screen material 13 are then cut to fit within perimeter frame 14 and secured with weather stripping 22. Loops 28, 28*a* are positioned and secured in a spaced apart relationship on the top of perimeter frames 14. Hooks 30, 30*a* are installed in window frame casing 18 to correspond to loops 28, 28*a* so combination control panel 10 may be hung. Spring clips 32, 32*a* are screwed into window casing frame 18 to forcefully engage the weather stripped surface of perimeter frames 14 of combination control panel 10 against window casing frame 18. It should be appreciated that the fabrication of combination control panel 10 is extremely simple and that its initial installation is equally simple. Combination control panel 10 can be removed easily for cleaning or for emergency exits through the window.

The extremely tight seal of combination control panel 10 against window casing frame 18 provides nearly 100% efficiency in preventing the penetration of cold air and of insects around frame 14 compared to the poor efficiency of conventional storm and screen windows. The use of weather stripping 22 in a dual function contributes to this high efficiency. Also contributing to the efficiency of combination control panel 10 is the fact that it is sealed flush against the interior casing 18 of the window frame. Combination control panel 10 is far less expensive to manufacture and install than conventional combination windows now in use which require a loose fitting guide track.

Combination control panel 10 can effect significant results through its high efficiency. It is also extremely efficient and inexpensive to manufacture. Combination control panel 10 provides structural rigidity, minimal hardware for installation, easy mounting and dismounting, is practically invisible to see when installed and, if seen, is attractive in appearance, provides an extremely tight and efficient air seal and is very inexpensive. It provides protection from penetration of cold air and of insects around its frames which has hitherto been unobtainable, especially for the residential user.

To summarize the invention, combination control panel 10 has two aluminum perimeter frames 14, one full frame 10*a* with a cross-member 16 in which a piece of glass and a piece of screening material 12 are set in the upper and lower halves respectively, a half-frame 10*b* having glass only and the edges of perimeter frames 14 are lined with a tubular resilient weather stripping 22 which holds screening material in place and serves to effect an air-tight fit. Combination control panel is hung on the interior of a window casing frame 18 by two loops 28 at the top of full perimeter frame 14 which engage two hooks 30 on casing frame 18 and these perimeter edges are secured by a few spring clips 32. Half-frame portion 10*b* is hung by loops 28*a* on hooks 30*a* on horizontal cross-member 16 for use as an air control panel. For storage it is hung on hooks 30. If combination control panel is to sit on a window sill, a piece of angular aluminum may be installed against which the base of combination control panel 10 abuts. Installation time for combination control panel 10 is three minutes.

I claim:

1. A combination control panel for insulating and screening windows comprising:

a light weight perimeter frame for mounting on internal, in situ, window frames of buildings, said perimeter frame having side and end members sized to fit the casements of said windows snugly;

a horizontal cross member for structural rigidity and to divide said full frame portion into two distinct sections;

at least one transparent sheet of a rigid material having high surface abrasion resistance secured in the upper section of said full frame;

said transparent sheet being secured within the interior edges of said perimeter frame by an air tight sealing material;

resilient, compressible tubular weather stripping secured in a ridge along the window frame engaging surface of said perimeter frame;

at least one sheet of a screen material secured in the lower section of said full frame;

said sheet of screen material being secured within the interior edges of said perimeter frame by an air-tight sealing material;

said weather stripping also serving to secure said screen material to said perimeter frame;

a hanging means including spaced apart loops secured to the upper edge of said perimeter frame positioned to engage complementary hooks on said window frame; and spring clip means to retain said full frame section securely in an air tight relationship to said window frame; a half frame; said combination control panel further including a half frame panel portion comprising;

a light weight perimeter frame for mounting on said internal, in situ, full frame panel said perimeter frame having side and end members sized to fit the perimeter of said full-frame panel snugly;

at least one transparent sheet of rigid material having high surface abrasion resistance;

said transparent sheet being secured within the interior edges of said half-frame perimeter frame by an air tight sealing material;

a resilient, compressible tubular weather stripping secured in a ridge along the perimeter frame engaging surface of the said full frame panel;

a hanging means including spaced apart loops secured to the upper edge of said perimeter frame positioned to engage complementary hooks on the horizontal cross-member of said full frame panel portion; and spring clip means to retain said air control panel securely in an air tight relationship to said full frame panel portion.

2. The combination panel of claim 1 wherein said air tight sealing material is marine glazing.

3. The combination control panel of claim 1 wherein said rigid transparent material is glass.

4. The combination control panel of claim 1 wherein said spring clip means are mounted on said window frame.

* * * * *